US009487324B2

(12) United States Patent
Benkö et al.

(10) Patent No.: US 9,487,324 B2
(45) Date of Patent: Nov. 8, 2016

(54) SHEET PACKAGING MATERIAL FOR PRODUCING SEALED PACKAGES OF POURABLE FOOD PRODUCTS

(75) Inventors: Gabor Benkö, Lund (SE); Angelo Sorbara, Rubiera (IT); Cristiano Casale, Spilamberto (IT); Marco Marchetti, Carpi (IT); Sebastian Heinonen, Bjärred (SE); Domenico Didonna, Modena (IT); Tiziana Cavecchia, Modena (IT); Claudio Casarini, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 703 days.

(21) Appl. No.: 13/388,325

(22) PCT Filed: Jun. 18, 2010

(86) PCT No.: PCT/EP2010/058604

§ 371 (c)(1),
(2), (4) Date: Feb. 1, 2012

(87) PCT Pub. No.: WO2011/020634

PCT Pub. Date: Feb. 24, 2011

(65) Prior Publication Data

US 2012/0138634 A1 Jun. 7, 2012

(30) Foreign Application Priority Data

Aug. 17, 2009 (EP) ..... 09168013

(51) Int. Cl.
*B65D 35/38* (2006.01)
*B65D 5/74* (2006.01)
*B65D 5/06* (2006.01)

(52) U.S. Cl.
CPC ..... *B65D 5/748* (2013.01); *B65D 5/064* (2013.01); *Y10T 428/15* (2015.01)

(58) Field of Classification Search
CPC ..... B65D 5/747–5/749; B65D 5/029; B65D 5/064; B65D 5/065; B65D 5/068
USPC ..... 222/83, 83.5, 88, 541.2; 229/125.14, 229/125.15, 200, 206
See application file for complete search history.

(56) References Cited

U.S. PATENT DOCUMENTS 2,288,914 A * 7/1942 Monroe ..... 229/213
2,601,399 A 6/1952 Jones (Continued)

FOREIGN PATENT DOCUMENTS

CA 2451751 A1 1/2003
DE 38 08 303 A1 9/1989

(Continued)

OTHER PUBLICATIONS

Japanese Office Action dated Apr. 8, 2014, issued in corresponding Japanese Patent Application No. 2012-525099 with an English translation of the Office Action. (5 pgs).

(Continued)

*Primary Examiner* — J. Casimer Jacyna
(74) *Attorney, Agent, or Firm* — Buchanan Ingersoll & Rooney PC

(57) ABSTRACT

A sheet packaging material for producing a sealed package of a pourable food product comprises one base layer, a number of lamination layers covering both sides of the base layer, and a removable portion which, in use, can be detached partly from the rest of the packaging material along at least one arc-shaped cutting line and folded at a folding zone extending between opposite ends of the cutting line to free a pour opening; the removable portion comprises a central area made of whole packaging material and which, in use, remains attached to the rest of the packaging material through a permanent bridge defined by the folding zone, and a peripheral area for cutting interaction, extending around part of the central area, containing the cutting line and including at least one pre-laminated opening formed by a through slot at least in the base layer and covered by one or more of the lamination layers.

28 Claims, 9 Drawing Sheets

(56) References Cited

U.S. PATENT DOCUMENTS

| | | | | |
|---|---|---|---|---|
| 2,731,188 | A | 1/1956 | Alden | |
| 2,750,096 | A | 6/1956 | Misch | |
| 4,126,263 | A | 11/1978 | Martensson | |
| 4,258,876 | A * | 3/1981 | Ljungcrantz | 229/125.14 |
| 4,930,683 | A | 6/1990 | Farber | |
| 4,948,015 | A | 8/1990 | Kawajiri et al. | |
| 5,960,992 | A * | 10/1999 | Bernstein et al. | 222/83.5 |
| 6,279,779 | B1 | 8/2001 | Laciacera et al. | |
| 6,398,075 | B1 | 6/2002 | Laciacera et al. | |
| 6,571,994 | B1 * | 6/2003 | Adams et al. | 222/521 |
| 7,207,465 | B2 | 4/2007 | Weist | |
| 7,427,005 | B1 * | 9/2008 | Lohrman | 222/541.2 |
| 7,458,486 | B2 | 12/2008 | Weist et al. | |
| 2004/0149786 | A1 | 8/2004 | Dubach | |
| 2007/0040009 | A1 * | 2/2007 | Sase et al. | 229/125.14 |
| 2007/0228128 | A1 | 10/2007 | Kieser | |
| 2010/0264146 | A1 | 10/2010 | Casale et al. | |
| 2012/0138634 | A1 | 6/2012 | Benko et al. | |

FOREIGN PATENT DOCUMENTS

| | | | |
|---|---|---|---|
| EP | 0130666 | A2 | 1/1985 |
| EP | 0577867 | A1 | 1/1994 |
| EP | 1088764 | A1 | 4/2001 |
| EP | 1338521 | A1 | 8/2003 |
| EP | 1 623 931 | A1 | 2/2006 |
| EP | 1513732 | B1 | 3/2006 |
| EP | 1509456 | B1 | 6/2006 |
| EP | 2055640 | A1 | 5/2009 |
| EP | 2287082 | A1 | 2/2011 |
| EP | 2467302 | B1 | 8/2013 |
| GB | 1535630 | A | 12/1978 |
| JP | 02-0634 | A | 1/1990 |
| JP | 9-501890 | A | 2/1997 |
| JP | 2002012229 | A | 1/2002 |
| JP | 2002080039 | A | 3/2002 |
| JP | 2004514612 | A | 5/2004 |
| JP | 2008503409 | A | 2/2008 |
| JP | 4257835 | B2 | 4/2009 |
| WO | 95/05996 | A1 | 3/1995 |
| WO | 0244040 | A1 | 6/2002 |
| WO | 2006/000881 | A2 | 1/2006 |
| WO | 2009/060005 | A2 | 5/2009 |
| WO | 2011/020634 | A1 | 2/2011 |

OTHER PUBLICATIONS

Opposition dated May 28, 2014 filed by Elopak System AG in corresponding European Application No. 10727389.8/ in European Patent No. 2467302, together with two pages of drawings and two pages of photographs (16 total pages).

Opposition dated May 27, 2014 filed by SIG Technology AG in European Patent Application No. 10727389.8 / in European Patent No. 2467302 and English translation of Opposition. (29 pages).

International Search Report (PCT/ISA/210) issued on Nov. 11, 2010, by European Patent Office as the International Searching Authority for International Application No. PCT/EP2010/058604.

Written Opinion (PCT/ISA/237) issued on Nov. 11, 2010, by European Patent Office as the International Searching Authority for International Application No. PCT/EP2010/058604.

Interlocutory Decision in Opposition Proceedings (Art. 101(3)(a) and 106(2) EPC) dated Mar. 10, 2015 in European Patent Application No. 09 168 013.2, now Patent No. EP-B-2 287 082. (11 pages).

Office Action issued on Mar. 18, 2016, by the Japanese Patent Office in corresponding Japanese Patent Application No. 2012-525099 and an English translation thereof. (9 pgs).

Office Action (Decision on the Grant) issued on Mar. 29, 2016, by the State Service of Intellectual Property of Ukraine in corresponding Ukrainian Application No. a201408341 (2 pgs).

Japanese Official Action issued Aug. 23, 2016, by the Japan Patent Office, in corresponding Japanese Patent Application No. 2015-127123 with English language translation of Official Action (9 pages).

* cited by examiner

SHEET PACKAGING MATERIAL FOR PRODUCING SEALED PACKAGES OF POURABLE FOOD PRODUCTS

TECHNICAL FIELD

The present invention relates to a sheet packaging material for producing sealed packages of pourable food products.

BACKGROUND ART

As is known, many pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by folding and sealing laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminium foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically.

In order to complete the forming operations, the tube is filled with the sterilized or sterile-processed food product, and is sealed and subsequently cut along equally spaced cross sections; pillow packs are so obtained, which are then folded mechanically to form respective finished packages.

Alternatively, the packaging material may be cut into blanks, which are formed into packages on forming spindles, and the packages are then filled with the food product and sealed. One example of this type of package is the so-called "gable-top" package known by the trade name Tetra Rex (registered trademark).

To open the above packages, these are normally provided with a removable portion, which is partly detached by an opening device from the rest of the packaging material to free a pour opening through which to pour out the product.

The removable portion is formed on the packaging material prior to folding and sealing the packaging material to form the finished package.

The removable portion normally comprises a so-called "prelaminated" hole, i.e. a circular hole formed through the base layer only of the packaging material and covered, when the material is laminated, with the layers of heat-seal plastic material and barrier material, which adhere to one another at the hole.

Over the past few years, considerable research has been carried out within the industry to devise an effective, consistent method of opening prelaminated holes in such a manner as to achieve a clean cut about the edge of the pour-out opening, with no fraying impairing smooth pour-out of the food product.

Research has mainly been focused on devising various movements of the opening devices, when unsealing the packages, designed to cut the prelaminated hole as effectively as possible, and in particular on opening devices capable of unsealing the packages in one operation, i.e. severing the prelaminated hole and exposing the resulting opening in one user movement.

A first solution proposed is described, for example, in international Patent Application WO 95/05996, filed by the INTERNATIONAL PAPER Company, in which the opening device substantially comprises a frame, defining a spout and fitted about a removable portion of the package, a removable cap, screwed to the outside of the frame to close the spout, and a substantially tubular cylindrical cutter, screwed inside the frame, and which cooperates with the removable portion to detach it partly, i.e. with the exception of a small-angle flap, from the relative wall.

The cutter is activated by the cap by means of one-way ratchet-type transmission means, which are active when removing the cap from the frame. In the specific case described in the above international patent application, the cutter acts on the removable portion by means of an end edge parallel to the removable portion and having a number of teeth, all triangular and of the same height.

In actual use, the cutter moves spirally, with respect to the frame, from a raised rest position, in which the end teeth face the removable portion, into successive lowered cutting positions, in which the end teeth interact simultaneously with the removable portion.

Though successful in unsealing the packages in one operation, opening devices of the above type are unsatisfactory in that the teeth tend to "chew" the removable portion material, thus resulting in a jagged, frayed cut edge, which, at times, may divert flow of the food product as it is poured out. Moreover, the cut-off part of the removable portion remains hanging inside the package, and, in use, tends to at least partly clog the flow section of the spout, thus seriously interfering with outflow of the product.

To improve detachment of the removable portion from the rest of the packaging material, other solutions have been proposed, the most significant of which would appear to be those described in Patents EP-B-1513732 and EP-B-1509456, both filed by SIG Technology Ltd.

More specifically, in the first of the above solutions, the cutter is guided, as it penetrates the wall of the package, so that its travel comprises a first purely vertical translation portion, and a second purely horizontal rotation portion.

In the second solution, the travel of the cutter, when unsealing the package, comprises a first spiraling portion, and a second purely horizontal rotation portion.

Though improving cutting quality of the removable portion, the above solutions are still not altogether satisfactory in achieving a clean-cut edge with no fraying interfering with pour-out of the food product.

Finally, it should be pointed out that the above limitations are particularly noticeable when the removable portion of the package is made of particularly tough material, e.g. a barrier material covered with a polymer catalyzed with an organometal or metallocene. In which case, the removable portion tends to "stretch" rather than tear under the action of the cutter, thus resulting in an even more jagged, cut edge.

The Applicant has observed that effective, clean cutting of the removable portion does not depend solely on the type and movement of the opening device used, but also on the lamination quality of the hole formed through the base layer of the packaging material.

More specifically, the Applicant has observed that, the greater the area of the hole in the base layer to be laminated, the more difficult it is to achieve constant lamination pressure over the whole area, thus resulting in uneven thickness of the laminated polymer.

This therefore makes it difficult to achieve clean, consistent cutting of the removable portion using the many different types of currently existing opening devices.

Moreover, lamination of the hole in the base layer at higher and higher speed makes the quality of this operation very critical.

DISCLOSURE OF INVENTION

It is therefore an object of the present invention to provide a sheet packaging material, for sealed packages of pourable food products, adapted to be produced at high speed and provided with a removable portion having an improved lamination quality and which can be cut in a neat, consistent way.

According to the present invention, there is provided a sheet packaging material for producing a sealed package of a pourable food product, as claimed in claim 1.

Another object of the present invention is to provide a sealed package, for pourable food products, having a removable portion and a reclosable opening device which interact mutually to consistently produce, in one user movement, a pour opening with a clean-cut edge.

According to the present invention, there is provided a sealed package for pourable food products, as claimed in claim 26.

Another problem in connection with known packages and packaging materials is the limitation of the area of the removable portion, which, once partially detached from the rest of the packaging material, defines the pouring hole for the passage of the food product.

As previously mentioned, the removable portion is normally defined by a circular prelaminated hole arranged on the top wall of the package; this wall generally has one or more sealing bands limiting the amount of space available in which to provide the prelaminated hole.

In particular, in the case of packages formed from a tube of packaging material, the top wall is crossed along the centerline by a flat transverse sealing band folded down onto and coplanar with the top wall, and by an end portion of a flat longitudinal sealing band extending perpendicularly from the transverse sealing band. More specifically, the longitudinal sealing band extends along a portion of the top wall of the package, and downwards from the top wall along a lateral wall and a bottom wall of the package.

Likewise, spindle-formed packages also comprise a top wall crossed along the centerline by a flat transverse sealing band folded down onto and coplanar with the top wall.

In neither case can the prelaminated hole be formed on the sealing bands of the package, which would not only impair the integrity of the seals and the pouring of the food product, but would also pose problems in sealing the relative opening device onto an uneven surface.

Moreover, the prelaminated hole should be formed at a certain distance from the sealing bands; as a matter of fact, a prelaminated hole too close to a sealing band may be damaged during the formation thereof due to the heat and pressure applied in that zone.

The prelaminated hole can therefore only be formed in the limited flat portions adjacent to the sealing bands extending across the top wall of the package, which obviously limit the maximum size of the resulting pouring hole after the first opening of the package.

The bigger the pouring hole the better the pouring characteristics. Thus, there is a demand for bigger pouring holes and opening devices giving better pouring, particularly in view of the increasing number of physically different products marketed in packages made of paper-like packaging material, some of which, particularly semi-liquid products or products containing fibers or particles, require larger holes for the product to be poured smoothly.

A further problem posed with the above-described known packages is the complexity of the design of the cutter, the cap and the transmission means for producing the movement of the cutter during the first unscrewing of the cap from the frame; a great part of this complexity derives from the necessity of ensuring that the removable portion is not completely severed during the first opening of the package, so avoiding any risk that it may fall into the package content.

It is therefore a further object of the present invention to provide a sheet packaging material, for a sealed package of a pourable food product, having a larger removable portion than the known solutions and which is adapted to avoid any risk that the removable portion is completely severed during the first opening of the package.

According to the present invention, there is provided a sheet packaging material for producing a sealed package of a pourable food product, as claimed in claim 28.

An additional object of the present invention is to provide a sealed package, for pourable food products, having a larger removable portion than the known solutions and which is adapted to avoid any risk that the removable portion is completely severed during the first opening.

According to the present invention, there is provided a sealed package for pourable food products, as claimed in claim 35.

BRIEF DESCRIPTION OF THE DRAWINGS

Some preferred, non-limiting embodiments of the present invention will be described by way of example with reference to the accompanying drawings, in which.

BEST MODE FOR CARRYING OUT THE INVENTION

Figure 1:
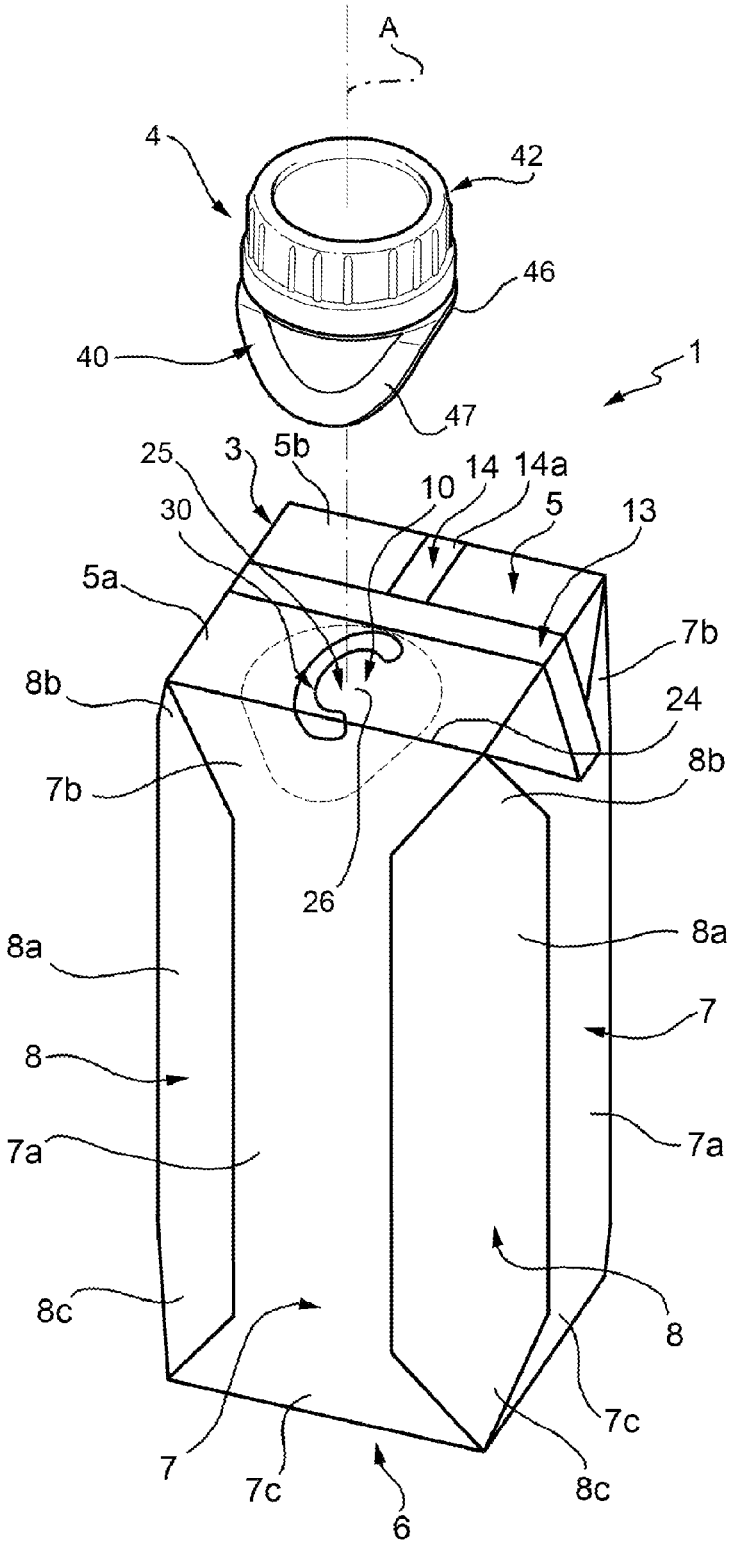
FIG. 1 shows an exploded view in perspective of a sealed package for pourable food products, in accordance with the teachings of the present invention.

Number 1 in FIG. 1 indicates as a whole a sealed package for pourable food products, which is made of multilayer sheet packaging material 2 (FIGS. 2 and 4) and is designed to be fitted, on a top portion 3, with a reclosable opening device 4 of plastic material.

In the non-limiting example shown in the drawings, opening device 4 is of a type very similar to the one disclosed in EP-A-2055640 and may be also replaced with the latter. It should also be noted that other opening devices may be used, such as the one disclosed in EP-A-1088764. Opening device 4 is applied to package 1 by conventional fastening systems, such as adhesives, or by micro-flame, electric-current-induction, ultrasound, laser, or other heat-sealing techniques.

Package 1, shown in FIG. 1, is of the type described in European patent application No. EP-A-1338521. It is pointed out that the present invention may be also applied to other types of sealed packages, such as parallelepiped- or prismatic-shaped packages, "gable-top" packages, and so on.

With reference to FIG. 1, package 1 comprises a quadrilateral (in the example shown, rectangular or square) top wall 5, a quadrilateral (in this case, rectangular or square) bottom wall 6, four lateral walls 7, extending between top wall 5 and bottom wall 6, and four corner walls 8, each located between a respective pair of adjacent lateral walls 7 and also extending between top wall 5 and bottom wall 6.

Each lateral wall 7 comprises a rectangular intermediate portion 7*a*, and opposite, respectively top and bottom, isosceles-trapezium-shaped end portions 7*b*, 7*c*, the minor bases of which are equal and defined by opposite horizontal sides of intermediate portion 7*a*, and the major bases of which coincide with the corresponding sides of top wall 5 and bottom wall 6 respectively.

Each corner wall 8 comprises a rectangular intermediate portion 8*a*, and opposite, respectively top and bottom, triangular end portions 8*b*, 8*c*, the bases of which are equal and defined by opposite horizontal sides of intermediate portion 8*a*, and the apexes of which coincide with the corners of top wall 5 and bottom wall respectively. In other words, in the FIG. 1 configuration, the top end portions 8*b* have upward-facing apexes, and the bottom end portions 8*c* have downward-facing apexes.

On the side facing inwards of package 1, each end portion 7*b*, 7*c*, 8*b*, 8*c* forms an angle of over 90° but less than 180° with the adjacent top wall 5 or bottom wall 6.

On top, package 1 has a removable portion 10 that, in use, as it will be better explained thereinafter, can be detached partly from packaging material 2 by opening device 4 to free a pour opening 9 (please see FIG. 6) by which to pour the food product from package 1.

The packaging material 2 from which package 1 is made has a multilayer structure (FIG. 4) comprising a base layer 11, e.g. of paper, for stiffness, and a number of lamination layers 12 covering both sides of base layer 11.

In the example shown, lamination layers 12 comprise a layer 12*a* of oxygen-barrier material, e.g. an aluminum foil, and a number of layers 12*b* of heat-seal plastic material covering both sides of both base layer 11 and layer 12*a*. In other words, the FIG. 4 solution comprises, in succession and from the side eventually forming the inside of package 1, a layer 12*b* of heat-seal plastic material, a layer 12*a* of barrier material, another layer 12*b* of heat-seal plastic material, base layer 11, and another layer 12*b* of heat-seal plastic material.

The inner layer 12*b* of heat-seal plastic material contacting the food product, in use, may, for example, be made of strong, in particular, high-stretch, metallocene-catalyzed, low-linear-density (LLD) poly-ethylene.

Normally, layers 12*b* of heat-seal plastic material are laminated on the base layer 11 in a melted state, with successive cooling.

As a possible alternative, at least the inner layers of plastic material may be provided as prefabricated films, which are laminated on base layer 11; this technique allows reducing any risk of formation of holes or cracks at or around removable portion 10 during the forming operations for producing sealed package 1.

Figure 2:
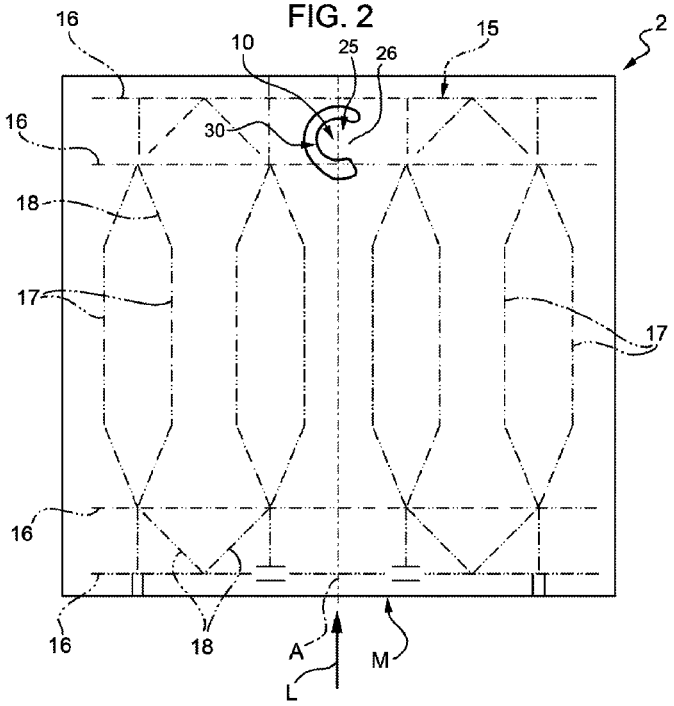
FIG. 2 shows a top plan view of a basic unit of packaging material by which to produce one package of the type shown in FIG. 1.

The letter M in FIG. 2 indicates a basic unit of packaging material 2, by which to produce package 1, and which may be a precut blank, or a portion of a web of packaging material comprising a succession of units M.

In the first case, basic unit M is folded on a known folding spindle (not shown), is filled with the food product, and is sealed at the top to form the final package. In the second case, the web of packaging material 2, comprising a succession of basic units M, is:

- folded into a cylinder and sealed longitudinally to form a vertical tube;
- filled continuously with the food product; and
- sealed transversely and cut into basic units M, which are then folded to form respective packages 1.

After completion of these operations, package 1 has a top transverse sealing band 13 crossing top wall 5 along a centre line thereof, a bottom transverse sealing band (not shown) crossing bottom wall 6 and a longitudinal sealing band 14 extending perpendicularly between the top transverse sealing band 13 and the bottom transverse sealing band along respective portions of top and bottom wall 5, 6 and along one of lateral walls 7.

More specifically, after package 1 is completely sealed and formed, top wall 5 is crossed by top transverse sealing band 13 and by an end portion 14*a* of longitudinal sealing band 14 extending perpendicularly from the top transverse sealing band 13; in greater detail, top transverse sealing band 13 divides top wall 5 into two regions 5*a*, 5*b* and end portion 14*a* of longitudinal sealing band 14 extends on one (5*b*) of such regions 5*a*, 5*b* from an intermediate portion of the top transverse sealing band 13.

During the forming operations to obtain package 1, top transverse sealing band 13 is folded on region 5*b* and end portion 14*a* of longitudinal sealing band 14; in this way, region 5*a* has a bigger area than region 5*b* and is therefore more suitable for receiving removable portion 10 and opening device 4, as will be explained in detail hereafter.

With particular reference to FIG. 2, basic unit M has a crease pattern 15, i.e. a number of crease lines defining respective fold lines, along which packaging material 2 is folded to form the finished package 1.

In the example shown, crease pattern 15 comprises first fold lines 16, extending horizontally in the FIG. 1 configuration of package 1, second fold lines 17, extending vertically in the FIG. 1 configuration of package 1, and third fold lines 18, sloping with respect to fold lines 16 and 17. Fold lines 16, 17, 18 define, in known manner, the various walls 5, 6, 7, 8 of package 1, and the various portions 7*a*, 7*b*, 7*c*, 8*a*, 8*b*, 8*c* of walls 7 and 8.

Removable portion 10 is formed on packaging material 2 prior to folding and sealing the packaging material to form package 1, and is covered, in use, by opening device 4, as shown clearly in FIG. 1.

As previously indicated, under the action of opening device 4, removable portion 10 can be detached partly from the rest of packaging material 2 along one arc-shaped cutting line 20 and folded at a folding zone 21 extending between opposite ends of cutting line 20.

Removable portion 10 is advantageously located on basic unit M so as to cross one of the fold lines 16 defining, in use, an edge between two adjacent walls of package 1. More specifically, removable portion 10 is crossed by the fold line 16 defining, in use, the edge 24 between top wall 5 and top end portion 7*b* of one of lateral walls 7.

Figure 3:
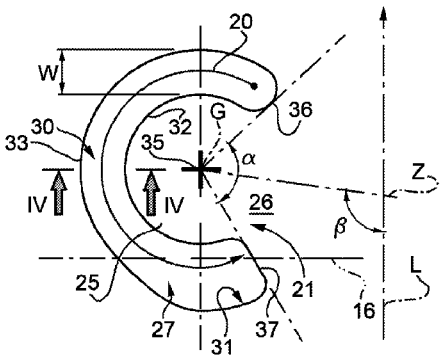
FIG. 3 shows a larger-scale top plan view of a removable portion of the FIG. 2 packaging material.
Figure 4:
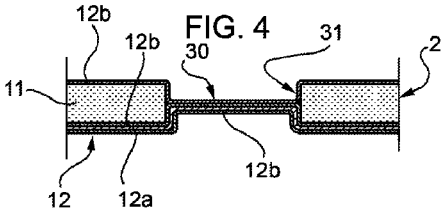
FIG. 4 shows a larger-scale section along line IV-IV in FIG. 3.

As shown in FIGS. 3 and 4, removable portion 10 comprises a central area 25 of whole packaging material, which, in use, in any case, remains attached to the rest of the packaging material of basic unit M through a permanent bridge 26 defined by folding zone 21, and a peripheral area 27 for cutting interaction (i.e. along which opening device 4 is designed to act during the first opening of package 1) extending around part of central area 25 and containing cutting line 20.

When, in use, removable portion 10 has been detached from the rest of the packaging material of the relative package 1 along cutting line 20 and is subjected to folding, permanent bridge 26 acts as a hinge, allowing rotation of the detached material inwards the package 1.

As shown in FIGS. 2 and 3, bridge 26 extends from central area 25 to the rest of packaging material 2 along a direction transversal to lamination direction L, i.e. the direction in which packaging material 2 is fed through a known roller laminating unit (not shown).

Peripheral area 27 is defined by an open, curvilinear strip having a single concavity facing central area 25. In practice, peripheral area 27 is substantially C-shaped.

According to the preferred embodiment shown in FIGS. 1 to 6, peripheral area 27 is completely defined by one prelaminated strip-like opening 30, which is formed by a through slot 31 provided in base layer 11 and covered by the other lamination layers 12*a*, 12*b*.

In this case, cutting line 20 is completely contained within prelaminated opening 30. This means that, in use, during the first opening of package 1, the cutting action performed by opening device 4 (as it will be explained in detail later on) only occurs along prelaminated opening 30.

Advantageously, as clearly visible in FIG. 4, lamination layers 12*b*, extending along opposite faces of base layer 11 are sealed together, during lamination, through slot 31. In this way, after cutting of removable portion 10 along cutting line 20, the edge of pour opening 9 is externally covered by the remaining part of lamination layers 12, so allowing to avoid the undesired phenomenon of "edge soaking", i.e. the imbibition of the paper edge due to storage of package 1 in a horizontal position after the first opening.

With particular reference to FIGS. 3 and 4, slot 31 in unit M of packaging material 2 is delimited by a first edge 32, adjacent to central area 25, and by a second edge 33, opposed to and facing edge 32; edges 32, 33 are joined together at respective opposite ends 36, 37 of slot 31.

The width W of slot 31, corresponding to the distance between opposite edges 32 and 33, ranges between 1 mm and 6 mm, and is preferably comprised between 2 mm and 5 mm.

The Applicant has observed that a width W of 1 mm is the minimum value for assuring proper lamination of layers 12 with sealing thereof through slot 31, and that, when the width W is larger than 6 mm, the area of prelaminated opening 30 drastically increases together with the probability of generating lamination defects; in fact, the larger the area of prelaminated opening 30 is, the more the movement of the melted plastic polymer at removable portion 10 is, so resulting in an uneven thickness of the lamination layers 12 at the area of slot 31 produced in base layer 11.

The angular distance between opposite ends 36, 37 of slot 31 with respect to the curvature centre G of cutting line 20 can be measured by an angle $\alpha$ (FIG. 3), which is comprised between the tangents to the above-mentioned ends 36, 37 ruled from centre G.

The Applicant has observed that high quality lamination and a clean and easy cut of peripheral area 27 of removable portion 10 can be obtained when angle $\alpha$ ranges between 10° and 160°, and preferably between 30° and 90°.

Another important parameter of prelaminated opening 30 is the angle, indicated as $\beta$, between the direction in which packaging material 2 is fed to the apparatus (not shown) for creating slot 31 and the direction showing the orientation of prelaminated opening 30, which can be represented by the bisector Z of angle $\alpha$.

It is pointed out that the direction of feeding packaging material 2 to the apparatus for creating slot 31 can coincide with lamination direction L.

In order to obtain high quality lamination and a clean and easy cutting of peripheral area 27 of removable portion 10, the Applicant has observed that angle $\beta$ has to range between 45° and 135°, preferably between 60° and 120°.

Centre G represents a sort of reference point for identifying the centre of the area delimited by prelaminated opening 30, which is not perfectly circular. This reference point is beneficial to measure the exact position of prelaminated opening 30 during the forming operations and to allow fitting of opening device 4 thereon with high accuracy.

In order to make easier the above operations, a reference mark 35, for instance cross-shaped, can be advantageously printed or creased within central area 25 of removable portion 10 at centre G; in particular, reference mark 35 can be provided either during the creasing operations, i.e. the operations for forming crease pattern 15, or during the cutting operation forming slot 31.

Figure 5:
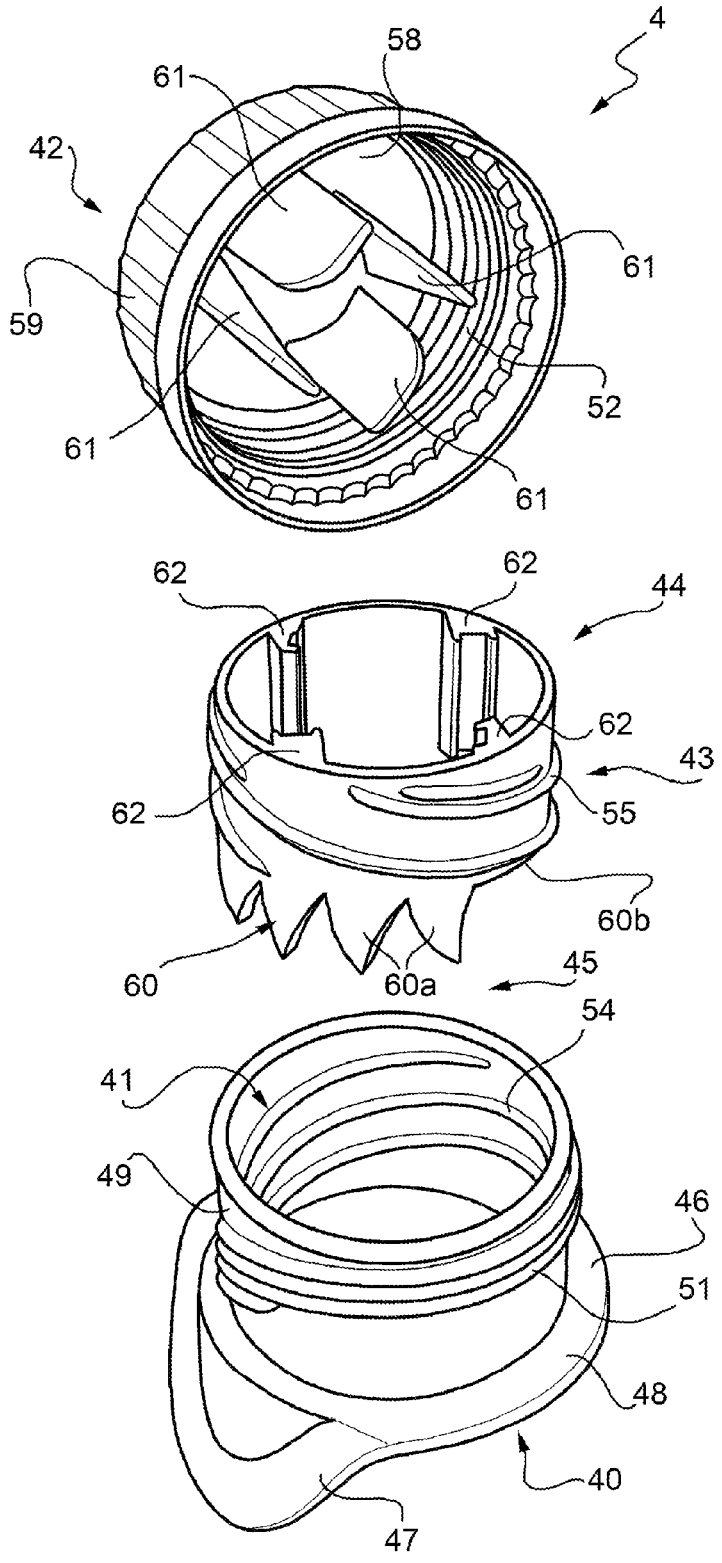
FIG. 5 shows a larger-scale, exploded view in perspective of a reclosable opening device by which to open the FIG. 1 package.
Figure 6:
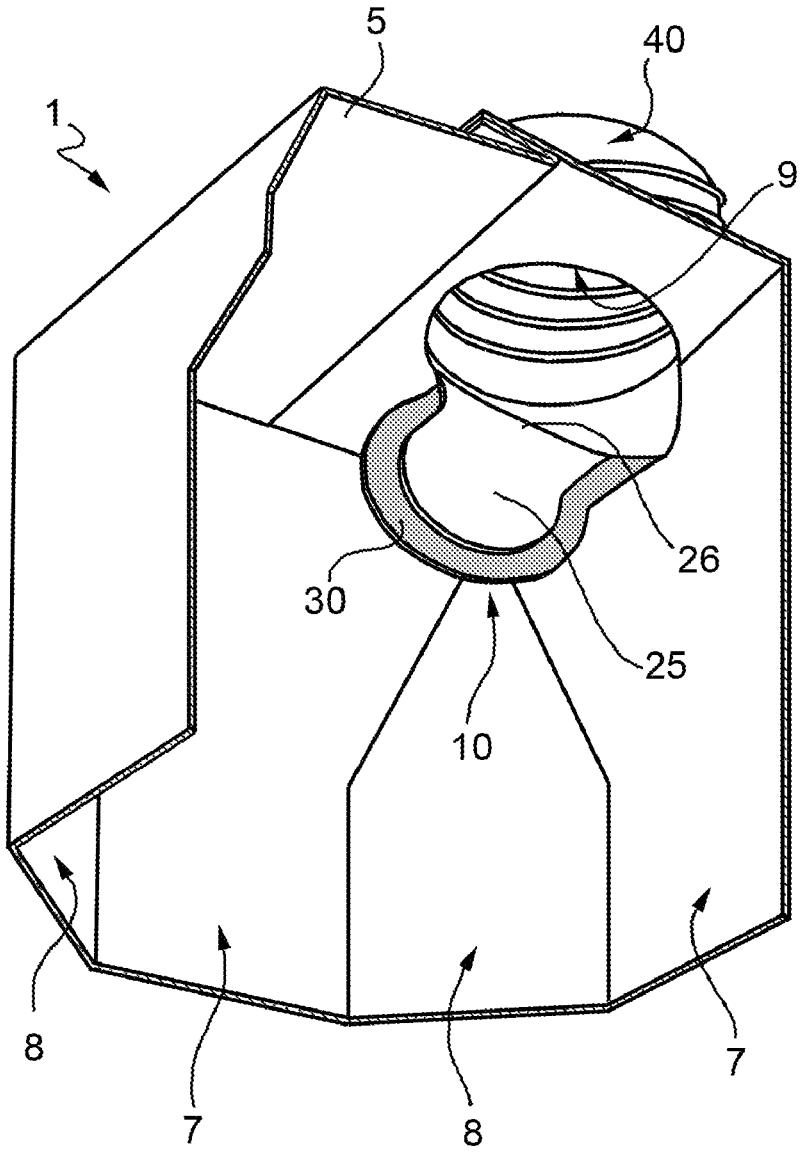
FIG. 6 shows a larger-scale view in perspective of a partially sectioned portion of the FIG. 1 package after the first opening.

With reference to FIGS. 1, 5 and 6, opening device 4 comprises a frame 40, fitted to package 1, about removable portion 10, and having a circular spout 41, of axis A, through which the food product is poured, a removable screw cap 42, fitted coaxially to spout 41 to close it, and a tubular cutter 43, of axis A, which, in use, engages spout 41 in axially and angularly movable manner and interacts with peripheral area 27 of removable portion 10 to partly detach removable portion 10 along cutting line 20 from the rest of the packaging material to open package 1.

Opening device 4 also comprises first connecting means 44, connecting cap 42 to cutter 43, and which, in use, as cap 42 is unscrewed off frame 40, exert rotational thrust on cutter 43, and second connecting means 45, connecting frame 40 to cutter 43, and which, in use, feed cutter 43 along a helical penetration path through peripheral area 27 of removable portion 10 in response to unscrewing of cap 42.

Opening device 4 is fitted to package 1 in such a way to have axis A of spout 41, cap 42 and cutter 43 centered on reference mark 35 of removable portion 10, and therefore on centre G of the designed cutting line 20.

Like removable portion 10, frame 40 advantageously crosses edge 24 between top wall 5 and top end portion 7*b* of one of lateral walls 7 of package 1, and comprises a first and second portion 46, 47 at the same angle to each other as that between walls 5 and 7.

More specifically, frame 40 comprises an annular base flange 48, defining portions 46 and 47 fastening the frame to respective walls 5, 7, and a tubular, cylindrical collar 49, of axis A, which projects from a radially inner edge of flange 48, on the opposite side to that fixed to walls 5, 7, defines spout 41, and is designed to receive cap 42.

As shown in FIG. 5, collar 49 comprises an outer cylindrical surface, having a first thread 51 which, in use, engages a corresponding thread 52 of cap 42, and an opposite inner cylindrical surface, defining spout 41 and having a thread 54 which, in use, engages a corresponding thread 55 of cutter 43.

Thread 54 of collar 49 of frame 40, and thread 55 of cutter 43 together define connecting means 45.

Cap 42 comprises a circular end wall 58 for closing spout 41 of frame 40, and a substantially cylindrical lateral wall 59, projecting coaxially from the peripheral lateral edge of end wall 58, and the inner surface of which supports thread 52 engaging outer thread 51 of collar 49 of frame 40.

As shown in FIG. 1, when cap 42 is fitted to frame 40, lateral wall 59 covers the outside of collar 49.

Cutter 43 is initially fitted completely inside collar 49 of frame 40 (FIG. 1), and, after package 1 is unsealed, is positioned partly inside the package, after partly detaching removable portion 10 from the rest of the packaging material.

At one axial end, cutter 43 (FIG. 5) has a cutting edge 60 that interacts with peripheral area 27 of removable portion 10 of package 1 to detach removable portion 10 partly from the adjacent packaging material.

Cutting edge 60 comprises a number of substantially triangular teeth 60*a* extending along a predetermined arc and an area 60*b* of a given angular dimension, withdrawn axially with respect to teeth 60*a* and having no cutting function.

Connecting means 44 comprise a number of—in the example shown, four—actuating members 61, located on end wall 58 of cap 42 and equally spaced angularly about axis A, and a number of corresponding driven members 62, located on the inner lateral surface of cutter 43, and which are pushed by respective actuating members 61 as cap 42 is first unscrewed off frame 40.

In other words, actuating members 61 and corresponding driven members 62 together define a one-way actuating device by which cap 42 is connected rotationally to cutter 43 in the unscrewing direction (anticlockwise in the drawings) of cap 42, but is disconnected in the opposite direction.

Actuating members 61 and driven members 62 are defined by contoured projections, which projects respectively from the surface of end wall 58 of cap 42 facing spout 41 in use and from the inner lateral surface of cutter 43.

In actual use, package 1 is unsealed by rotating cap 42 in the open direction (anticlockwise in FIG. 1) so that it gradually disengages from frame 40 and, at the same time, operates cutter 43 by actuating members 61 engaging driven members 62.

That is, threads 51 and 52 interact so that cap 42 moves spirally, with respect to frame 40, about axis A, and withdraws axially from the frame, away from flange 48. At the same time, actuating members 61 of cap 42 act on driven members 62 of cutter 43 to also rotate the cutter about axis A. The interaction of threads 54 and converts rotation of cutter 43 by cap 42 into a spiral movement of cutter 43 first towards and then through removable portion 10.

As it moves, cutting edge 60 interacts with prelaminated opening 30 of peripheral area 27 of removable portion 10 to produce cutting line 20. More specifically, cutting edge 60 first pierces lamination layers 12*a*, 12*b* covering slot 31 at an end portion thereof and, from there, advances along, and cuts, the whole of prelaminated opening 30 in the travelling direction—anticlockwise in FIGS. 1 and 5—of cutter 43.

At this point, after the complete penetration of cutting edge 60 into prelaminated opening 30, with the consequent whole detachment of removable portion 10 along cutting line 20, further rotation of cutter 43 produces a folding action along bridge 26, which remains intact and acts as a hinge. More specifically, removable portion 10 is folded outwards of cutter 43 (FIG. 6) and kept in this position by the cutter to clear the way for pour-out of the food product.

The total cutting angle is therefore less than a full turn and substantially comprised between 200° and 350°, and preferably between 270° and 330°, thus preventing total detachment of removable portion 10 from the adjacent portions of packaging material.

As cap 42 is unscrewed further, actuating members 61 are withdrawn axially from driven members 62, thus arresting cutter 43 in the lowered opening position, in which it projects axially inwards of package 1 from frame 40 (FIG. 6), but is still connected to collar 49 by thread 54 engaging thread 55.

Cap 42 is then unscrewed completely to open package 1, which can be reclosed by simply screwing cap 42 back onto collar 49.

Once package 1 is opened, cutter 43 can no longer be moved from the lowered opening position, on account of actuating members 61 being unable to reach an axial position engaging driven members 62 of cutter 43.

In the lowered opening position, cutter 43 holds back the cut-off part of removable portion 10 (FIG. 6) to prevent it clogging spout 41 through which the food product is poured.

Number 10', 10'', 10''' and 10'''' in FIGS. 7 to 11 indicate different embodiments of a removable portion of packaging material 2 in accordance with the present invention; removable portions 10, 10', 10'', 10''' and 10'''' being similar to each other, the following description is limited to the differences between them, and using the same references, where possible, for identical or corresponding parts.

Figure 7:
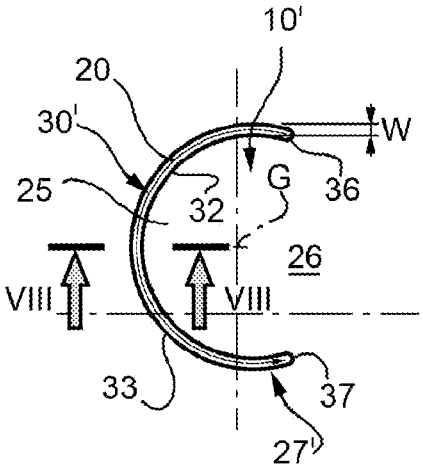
FIG. 7 shows a larger-scale top plan view of a different embodiment of a removable portion of the FIG. 2 packaging material.
Figure 8:
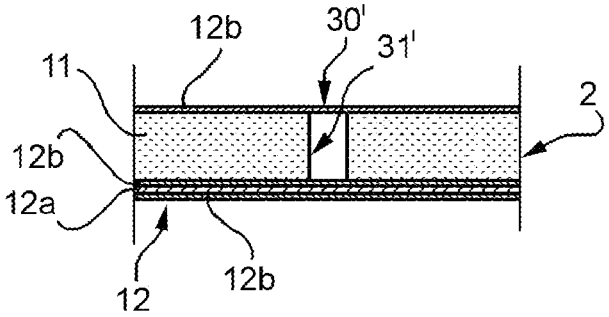
FIG. 8 shows a larger-scale section along line VIII-VIII in FIG. 7.

In the embodiment shown in FIGS. 7 and 8, removable portion 10' has a peripheral area 27', which is completely defined by a single arc-shaped prelaminated opening 30' having the same curvature centre G as cutting line 20. In practice, prelaminated opening 30' has a substantially semicircular strip shape and is formed by an equally shaped through slot 31' produced in base layer 11 of packaging material 2 and covered by lamination layers 12.

Advantageously, the width W of slot 31' is constant and is kept at the minimum for allowing cutting interaction, i.e. for allowing engagement by teeth 60*a* of cutter 43 of opening device 4. In other words, the width W of slot 31' ranges between 0.5 mm and 0.9 mm so as to match almost exactly the width of teeth 60*a* of cutter 43.

In this solution, as shown in FIG. 8, at removable portion 10', lamination layers 12 of packaging material 2 cannot be sealed together through slot 31', as the latter has a width W too narrow.

Slot 31' may be produced in base layer 11 of packaging material 2 by using a laser cutting device (not shown).

Figure 9:
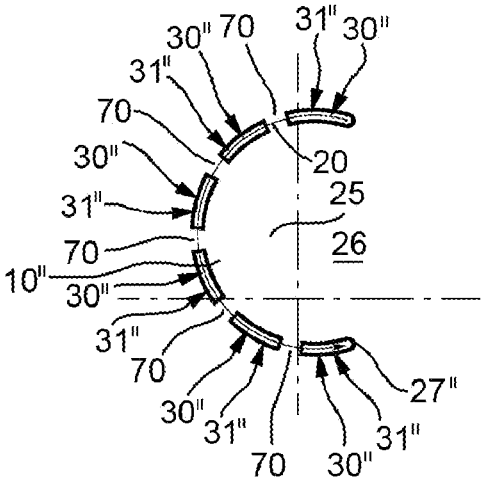
FIGS. 9, 10, 11 and 12 show larger-scale top plan views of other different embodiments of a removable portion of the FIG. 2 packaging material.

In the embodiment of FIG. 9, peripheral area 27" of removable portion 10" has the same arc shape of peripheral area 27' of removable portion 10' and differs from peripheral area 27' by comprising a succession of prelaminated openings 30" alternated with respective bridges 70 of whole packaging material, joined to central area 25.

In practice, in this case, peripheral area 27" is obtained by producing a succession of spaced perforations or through slots 31" in base layer 11 of packaging material 2, externally covered by lamination layers 12.

The operation of perforating base layer 11 may be advantageously performed by using a laser cutting device.

As shown in FIG. 9, cutting line 20 crosses bridges 70: this means that, during the first opening of package 1, bridges 70 are completely severed by cutter 43.

Figure 10:
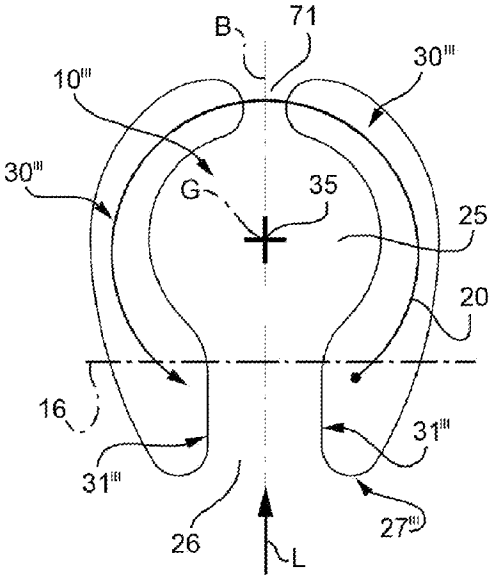

In the embodiment shown in FIG. 10, removable portion 10''' has a peripheral area 27''', which comprises two prelaminated openings 30''' facing each other and separated by permanent bridge 26 and by another bridge 71 of whole packaging material, joined to central area 25.

Preferably, cutting line 20 crosses bridge 71: this means that, during the first opening of package 1, bridge 71 is completely severed by cutter 43.

As clearly visible in FIG. 10, prelaminated openings 30''' are symmetrically-shaped with respect to an axis B connecting bridges 26 and 71, passing along centre G of cutting line 20 and extending orthogonally to axis A of spout 41, cap 42 and cutter 43 of opening device 4.

Advantageously, axis B connecting bridges 26 and 71 is parallel to lamination direction L of packaging material 2.

More specifically, in the present case, lamination direction L is from bridge 26 to bridge 71, which is shorter than bridge 26.

As shown in FIG. 10, each prelaminated opening 30''' is roughly elongated bean-shaped and is formed by an equally shaped through slot 31''' produced in base layer 11 of packaging material 2 and covered by lamination layers 12.

Similarly to prelaminated opening 30 of removable portion 10, also in this embodiment, lamination layers 12 are sealed together through each slot 31'''.

In order to ease determination of the exact position of non-circular prelaminated openings 30''' during the forming operations and to allow fitting of opening device 4 thereon with high accuracy, also in this case, a reference mark 35, for instance cross-shaped, can be advantageously printed or creased within central area 25 of removable portion 10''' at centre G; in particular, reference mark 35 can be provided either during the creasing operations for forming crease pattern 15, or during the cutting operation forming slots 31'''.

Figure 11:
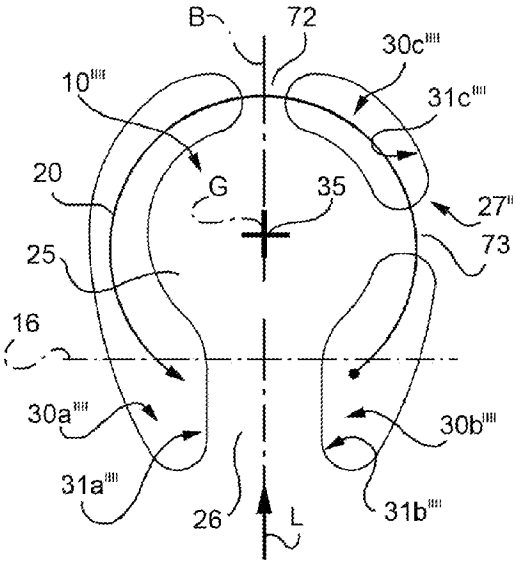

In the embodiment shown in FIG. 11, removable portion 10'''' has a peripheral area 27'''', which, when compared to peripheral area 27''' of removable portion 10''', has a first prelaminated opening 30*a*''''', corresponding to one of prelaminated openings 30''', and a second and a third prelaminated opening 30*b*''''', 30*c*''''', together replacing the other prelaminated opening 30'''.

Prelaminated opening 30*a*''''' is separated from prelaminated openings 30*b*''''' and 30*c*''''' respectively by permanent bridge 26 and by a completely severable bridge 72 of whole packaging material, corresponding to bridge 71 of peripheral area 27''' of removable portion 10'''; prelaminated openings 30*b*''''' and 30*c*''''' are separated from each other by a further completely severable bridge 73 of whole packaging material.

All bridges 26, 72 and 73 are joined to central area 25 of removable portion 10''''.

As shown in FIG. 11, prelaminated openings 30*a*''''', 30*b*''''', 30*c*''''' are roughly elongated bean-shaped and of different lengths: in particular, prelaminated opening 30*a*''''' extends roughly along a first half of peripheral area 27'''', whilst prelaminated openings 30*b*''''' and 30*c*''''' extend roughly along the other half of peripheral area 27'''' and therefore face prelaminated opening 30*a*''''''.

In practice, prelaminated opening 30*a*''''' extends along peripheral area 27'''' to a length roughly equal to or slightly longer than the total length of prelaminated openings 30*b*''''' and 30*c*''''', which are of comparable lengths.

Also in this case, prelaminated opening 30*a*''''', 30*b*''''', 30*c*''''' are formed by corresponding through slots 31*a*''''', 31*b*''''', 31*c*''''' produced in base layer of packaging material 2 and covered by lamination layers 12.

Similarly to prelaminated openings 30, 30''' of removable portions 10, 10'''', lamination layers 12 are sealed together through each slot 31*a*''''', 31*b*''''', 31*c*''''''.

Bridge 26, providing, in use, for permanently connecting removable portion 10'''' to the rest of packaging material 2, is longer than bridges 72, 73.

As shown in FIG. 11, bridges 26 and 72 are advantageously located opposite each other along an axis B parallel to the lamination direction L of packaging material 2, which, in this case, is from the longer bridge 26 to bridge 72.

Bridge 73 on the other hand is located to one side of axis B and facing prelaminated opening 30*a*''''''.

Furthermore, prelaminated openings 30*b*''''' and 30*c*''''' are located on the opposite side of axis B to prelaminated opening 30*a*''''', and the fold line 16 defining in use edge 24 of package 1 crosses both prelaminated openings 30*a*''''' and 30*b*''''''.

In order to ease determination of the exact position of non-circular prelaminated openings 30*a*''''', 30*b*''''', 30*c*''''' during the forming operations and to allow fitting of opening device 4 thereon with high accuracy, also in this case, a reference mark 35, for instance cross-shaped, can be advantageously printed or creased within central area 25 of removable portion 10'''' at centre G; in particular, reference mark 35 can be provided either during the creasing operations for forming crease pattern 15, or during the cutting operation forming slots 31*a*''''', 31*b*''''', 31*c*''''''.

Figure 12:
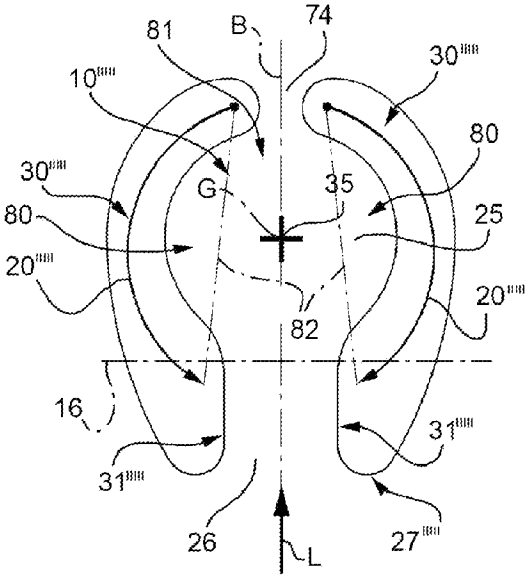

In the embodiment shown in FIG. 12, removable portion 10''''' has a peripheral area 27''''', which is very similar to peripheral area 27''' of removable portion 10''' and basically differs therefrom in that the cutting action is performed along two arc-shaped cutting lines 20''''' completely contained within the respective prelaminated openings 30'''''.

Preferably, as shown in FIG. 12, each cutting line 20''''' is directed from one end of the relative prelaminated openings 30''''' to the opposite end.

In this case, prelaminated openings 30''''' are separated by permanent bridge 26 and by another bridge 74, corresponding to bridge 71, but which is of permanent-type, i.e. it is not severed by cutter 43 during the first opening of package 1.

More specifically, to obtain unsealing of package 1, removable portion 10''''' is detached partly from the rest of packaging material 2 along the two arc-shaped cutting lines 20''''' so as to form two flaps 80, which are joined to a strip 81 of whole packaging material extending between bridges 26 and 74 and delimited by two additional folding lines 82.

In practice, the opening of package 1 is carried out by folding the two flaps 80 on either side of strip 81.

As a possible alternative, the cutting action may be also performed from the center of each prelaminated openings 30"" and progressing symmetrically in both directions.

Number 100 in FIGS. 13 to 16 indicates a further different embodiment of a removable portion in accordance with the present invention; removable portion 100 will be described by highlighting similarities and differences with respect to the previously described removable portions 10, 10', 10", 10"', 10"", 10""' and by using the same references, where possible, for parts already described or equivalent thereto.

Figure 13:
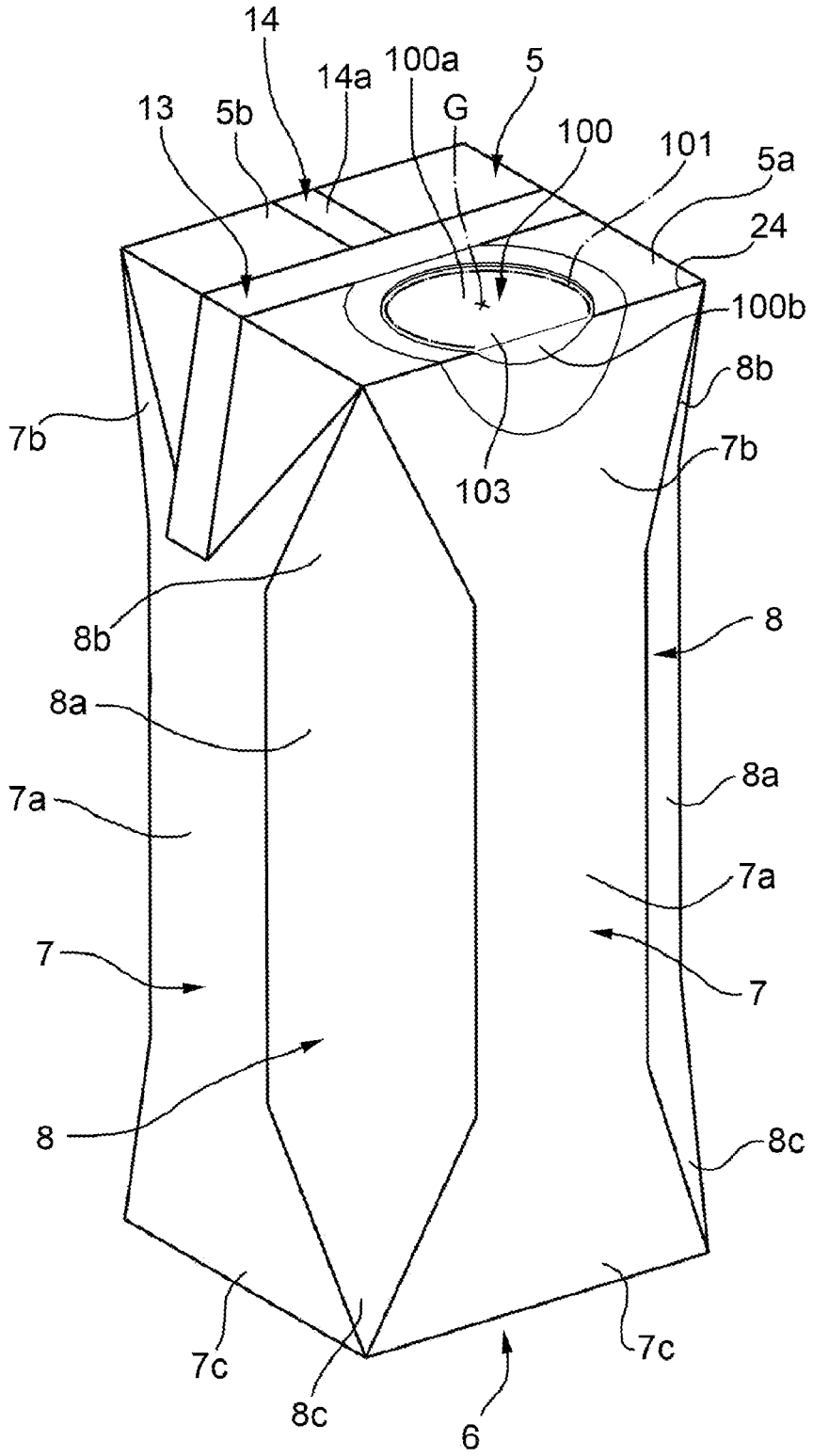
FIG. 13 shows an exploded view in perspective of the FIG. 1 package provided with a further different embodiment of a removable portion in accordance with the teachings of the present invention.
Figure 14:
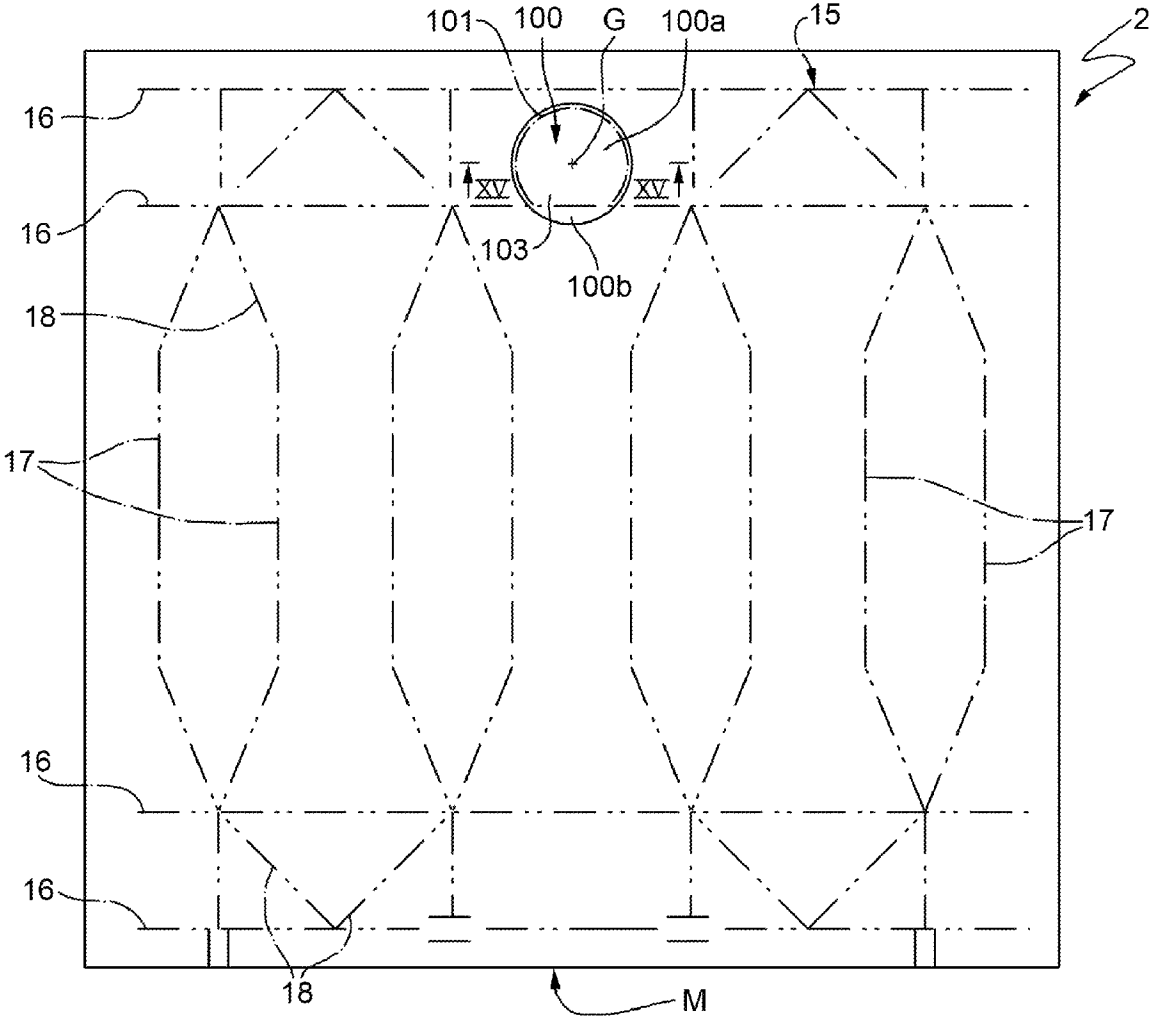
FIG. 14 shows a top plan view of a basic unit of packaging material by which to produce one package of the type shown in FIG. 13.
Figure 15:
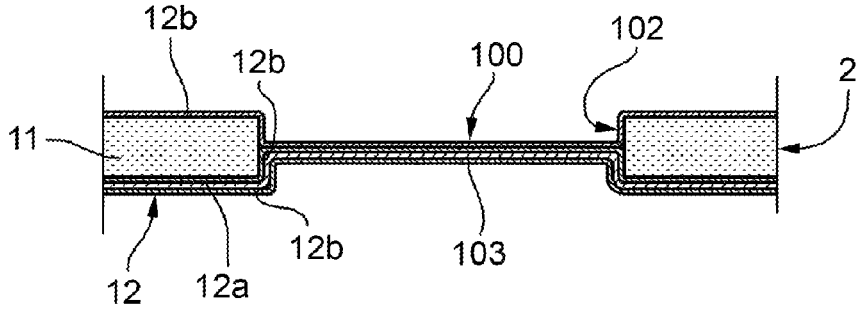
FIG. 15 shows a larger-scale section along line XV-XV in FIG. 14.
Figure 16:
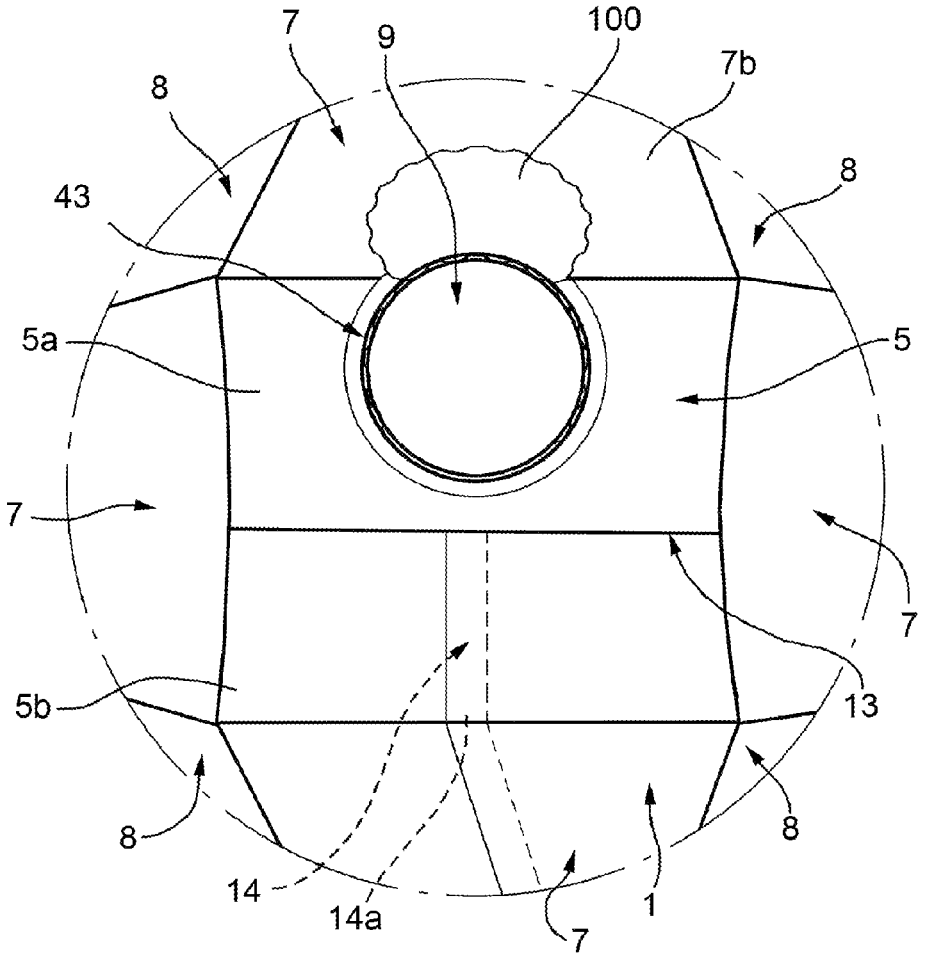
FIG. 16 shows a larger-scale view of the FIG. 13 package from the inside thereof and after the first opening.

Removable portion 100 is shown in FIGS. 13 and 14 as formed on package 1 and on basic unit M of packaging material 2, from which package 1 is obtained; it is pointed out that removable portion 100 may be advantageously formed even on different types of sealed packages, such as parallelepiped- or prismatic-shaped packages, "gable-top" packages, and so on, or even on packages having varying cross-sections of a main portion of the package.

In a manner completely equivalent to removable portions 10, 10', 10", 10"', 10"", 10""', also in this case, removable portion 100 is advantageously crossed by one of the fold lines 16 defining, in use, an edge between two adjacent walls of package 1. More specifically, removable portion 100 is crossed by the fold line 16 defining, in use, the edge 24 between top wall 5 and top end portion 7*b* of one of lateral walls 7, which normally defines the front panel of package 1.

In the example shown, removable portion 100 extends in part on region 5*a* of top wall 5 and in part on top end portion 7*b* of the adjacent lateral wall 7 located on the opposite side of top transverse sealing band 13 with respect to region 5*b*.

In particular, the fold line 16 crossing removable portion 100 divides the latter in a first and a second region 100*a*, 100*b* respectively located in use on the above-indicated distinct walls 5, 7 of package 1; the region 100*b* is smaller than the region 100*a*.

Under the action of opening device 4, removable portion 100 can be detached partly from the rest of packaging material 2 along one arc-shaped cutting line 101 contained in the region 100*a* and folded at a folding zone (FIGS. 13, 14 and 16) extending between opposite ends of cutting line 101 and defined by the region 100*b*; in practice, in this case, the region 100*b* acts in use as a hinge allowing rotation of the detached material inwards the package 1 and towards the lateral wall 7 on which such region is located (FIG. 16) in order to free the pour opening 9.

By being located not only on top wall 5 but also on the adjacent lateral wall 7, which is angled in relation to the top wall 5, the removable portion 10 will have a curvature on the finished package 1; in this way, the risks of completely severing the removable portion 100 during the first opening of the package 1 can be minimized, since the cutter of the opening device, even in the case in which it had a very simple design, e.g. subjected to an axial downward penetration movement (such as in EP-A-2055640) and provided with teeth lying on a common plane, would not be able to contact the entire removable portion 100 at the same time.

As shown in FIGS. 13 to 16, removable portion 100 differs from removable portions 10, 10', 10", 10"', 10"", 10""' by comprising one aperture 102 formed at least in base layer 11, covered by a cover material 103 and extending along the whole removable portion 100.

In particular, in this case, both aperture 102 and removable portion 100 have round or circular profiles with a centre G; the fold line 16 crossing removable portion 100 defines a chord thereof. In the embodiment shown in FIG. 14, the fold line 16 crossing the removable portion 100 is located at a minimum distance D from the centre G of the aperture 102 of about 70% of the radius of the aperture 102. It is also possible to locate the fold line 16 at a minimum distance D from the centre G of the aperture 102 being in the range of about 50 to 85% of the radius of the aperture 102, or in the range of about 60 to 80% of the radius of the aperture 102.

According to the preferred embodiment shown in the FIGS. 13 to 16, cover material 103 is defined by all the lamination layers 12; as a possible alternative not shown, cover material 103 may be also defined by only one or some of lamination layers 12.

According to another possible alternative not shown, aperture 102 may be formed through the entire packaging material 2, and cover material 103 may be defined, in this case, by a patch applied to the packaging material 2 to seal the aperture 102 and including layers of oxygen-barrier material, e.g. an aluminum foil, and one or more layers of heat-seal plastic material.

The advantages of packaging material 2 and package 1 according to the present invention will be clear from the above description.

In particular, by locating removable portions 10, 10', 10", 10"', 10"", 10""', 100 as described, astride two walls (5, 7) of package 1 at an angle to each other enables a big increase in the diameter of pour opening 9 and, hence, improved outflow of the food product from package 1.

This increase in the diameter of pour opening 9 is obtained without increasing the complexity of crease pattern 15.

Moreover, having a wider removable portion 100, which, after detachment from the rest of the packaging material 2, is folded inwards of package 1, allows to increase stability of the detached part with less interference with the product flow.

In the solution shown in FIGS. 13 to 16, the curvature of removable portion 100, deriving from the extension thereof on adjacent angled lateral wall 7 of package 1, allows to minimize the risks that it may be completely severed during the first opening of the package 1, even with very simple designs of the opening device. In the embodiment shown in FIGS. 13 and 14, the top panel 5 is substantially parallel to the bottom panel 6 and the top part 7*b* of the front panel 7 is angled in relation to the main part of the front panel. This results in an angle between the top panel 5 and the top part 7*b* of the front panel which is larger than 90 degrees, and is in the shown embodiment about 106 degrees. Having an angle between the panels that the removable portion 100 is located on which is larger than 90 degrees reduces the folding of the removable portion 100, and hence reduces the stress on said removable portion. It is hence conceived, in some embodiments, to have an angle between the top panel 5 and the top part 7*b* of the lateral wall 7, when folded into a package, which is in the range of 95 to 115 degrees, or in the range of 100 and 100 degrees.

It is also possible to have an angled top panel 5, in relation to the bottom panel 6, and a substantially vertical lateral panel 7 (when the package is standing), such that the above angle between top panel 5 and lateral panel 7 is greater than 90 degrees. One example of such a package is marketed by the applicant under the name Tetra Brik Edge.

In addition, the fact that the folding zone of the removable portion 100 is defined by the region 100*b* permits the detached material to be superimposed in a very good way upon the lateral wall 7 of package 1 on which such region is located; in this manner, it is possible to ensure a complete emptying of the package 1 even with a reduced complexity of the design of the opening device.

For a given size pour opening 9, the configurations of removable portions 10, 10', 10", 10''', 10'''' and 10''''' described and illustrated in FIGS. 1 to 12 provide for better lamination quality as compared with a prelaminated hole covering the whole pour opening area.

This is essentially due to a drastic reduction, during lamination, in movement of the polymer at removable portions 10, 10', 10", 10''', 10'''', 10''''' thus resulting in a much more even thickness of lamination layers 12 at respective slots 31, 31', 31", 31''', 31*a*''''', 31*b*''''', 31*c*''''', 31''''' than that of a conventional prelaminated hole defining the whole pour opening area.

Consequently, it is possible to obtain a wider processing window as compared with known prelaminated holes, e.g. faster lamination speed, and a big reduction in cost of the cover material of base layer 11.

In fact, by reducing movement of the polymer during lamination means the material can be fed faster through the lamination rollers, whereas the reduction in material cost derives from the solutions described and illustrated enabling the use of laminating materials having reduced basis weight.

Improving the lamination quality of the area for cutting interaction (peripheral area 27, 27', 27", 27''', 27'''', 27''''') enables consistent neat cutting of removable portion 10, 10', 10", 10''', 10'''', 10''''' even when using an inner layer of high-stretch heat-seal plastic material.

In addition, this makes it easier to locate the removable portion 10, 10', 10", 10''', 10'''', 10''''' in any convenient position on package 1, e.g. particularly across a fold line 16 of packaging material 2 and, therefore, an edge 24 of package 1.

As previously mentioned, in the specific solution of FIGS. 1 to 4, the width W and the angles α and β of the single prelaminated opening 30 are important parameters to be considered for minimizing movements of the melted plastic polymer at removable portion 10 during lamination and the probability of generating lamination defects. The same applies to the solution of FIGS. 7 and 8.

In the cases of FIGS. 10, 11 and 12, the reduction, during lamination, in movement of the polymer at removable portions 10''', 10'''', 10''''' is obtained by locating bridges 26 and 71, 74 of whole packaging material aligned along an axis (B) parallel to the lamination direction (L) of the packaging material. The Applicant, in fact, has observed that movement of the polymer tends to be more marked in the areas defining the leading and trailing portions of the removable portion through the lamination rollers. Providing bridges (26; 71, 74) of whole packaging material just at these areas therefore greatly reduces movement of the polymer during lamination, thus resulting in a much more even thickness of lamination layers 12 at slots 31''', 31*a*''''', 31*b*''''', 31*c*''''', 31''''' than those of a conventional prelaminated hole defining the whole pour opening area.

Moreover, in the case of FIG. 11, locating a further bridge (73) to the side of axis B joining bridges 26 and 72 provides for maintaining the original position of removable portion 10''''' as bridge 72 is cut by cutting edge 60. That is, as cutting edge 60 advances through bridge 72, the thrust pushing removable portion 10''''' towards slot 31*a*''''' is counteracted by the reaction of bridge 73, thus preventing any lateral movement of removable portion 10'''''. It is clear that in this case, cutting edge 60 of opening device 4 should be designed to act, during the first opening of package 1, first on bridge 72 and then on bridge 73. For instance, this may be done by providing two groups of teeth 60*a* separated by an area of a given angular dimension, withdrawn axially with respect to teeth 60*a* and having no cutting function; the two groups should be positioned with respect to removable portion 10''''' and the helical path of cutter 43 so that one cuts bridge 72 before the other starts to cut bridge 73.

An important advantage of removable portions 10, 10' and 10''''' is the following: the cutting action is only performed through lamination layers 12 and not through base layer 11 in paper material; in this way, there is no risk that paper fibres may detach during the cutting action and fall into package 1.

Besides, the force required for opening package 1 for the first time is really of small entity.

Finally, the packaging material described provides for a high degree of integration with opening device 4, for the following reasons:

- the manufacturing process of packaging material 2 is designed to produce a removable portion 10, 10', 10", 10''', 10'''', 10''''', 100 comprising one or multiple prelaminated holes that are easier to sever by opening device 4;
- package 1 can be unsealed in one movement, with very little effort on the part of the user;
- once the package is unsealed, removable portion 10, 10', 10", 10''', 10'''', 10''''', 100 detached partly from the rest of the packaging material, is retained between frame 40 and cutter 43, thus eliminating any risk of detachment.

Clearly, changes may be made to packaging material and package 1 as described and illustrated herein without, however, departing from the scope defined in the accompanying claims.

The invention claimed is:

1. A sheet packaging material for producing a sealed package of a pourable food product, said packaging material comprising:

at least one base layer for imparting stiffness;

at least one lamination layer applied to and covering said base layer; and a removable portion which, in use, is covered by an opening device that includes a rotatable cutter, the removable portion, in use, being partly detachable from a remainder of said packaging material along at least one arc-shaped cutting line by rotation of the cutter and folded at a folding zone extending between opposite ends of said cutting line so as to free a pour opening by which to pour the food product from said package, the removable portion including a center;

wherein said removable portion comprises:

a central area made of whole packaging material and which, in use, remains attached to the rest of the packaging material through a permanent bridge defined by said folding zone, the central area which is made of whole packaging material and which, in use, remains attached to the rest of the packaging material through the permanent bridge defined by said folding zone including the center of the removable portion; and a peripheral area for cutting interaction, extending around part of said central area, containing said cutting line and including at least one pre-laminated opening, which is formed by a through slot provided at least in said base layer and covered by said at least one lamination layer, and wherein said whole packaging material comprises said at least one base layer and said at least one lamination layer.

2. A packaging material as claimed in claim 1, wherein said permanent bridge acts as a hinge during folding of the removable portion.

3. A packaging material as claimed in claim 1, wherein said peripheral area for cutting interaction is defined by an open, curvilinear strip having a single concavity facing said central area.

4. A packaging material as claimed in claim 1, wherein said peripheral area for cutting interaction is completely defined by said pre-laminated opening.

5. A packaging material as claimed in claim 1, wherein said slot has a first edge adjacent to said central area and a second edge opposed to and facing said first edge, and wherein said slot possesses a width, as measured between said first edge and said second edge, ranging between 0.5 mm and 6 mm.

6. A packaging material as claimed in claim 1, wherein tangents to a first and a second end of said slot ruled from a curvature center of said cutting line define therebetween a first angle ranging between 10° and 160° .

7. A packaging material as claimed in claim 6, wherein a bisector of said first angle and the direction in which said packaging material is fed to an apparatus for providing said slot define therebetween a second angle ranging between 45° and 135° .

8. A packaging material as claimed in claim 1, wherein said prelaminated opening and said slot are arc-shaped and have the same curvature center as said cutting line.

9. A packaging material as claimed in claim 5, wherein the width (W) of said slot ranges between 1 mm and 6 mm.

10. A packaging material as claimed in claim 1, further comprising two lamination layers applied to and covering both sides of said base layer, and wherein said lamination layers are sealed together, during lamination, through said slot.

11. A packaging material as claimed in claim 5, wherein the width of said slot is kept at a minimum for allowing cutting interaction.

12. A packaging material as claimed in claim 11, wherein the width of said slot ranges between 0.5 mm and 0.9 mm.

13. A packaging material as claimed in claim 1, wherein said peripheral area for cutting interaction comprises a succession of said prelaminated openings alternated with respective further bridges of whole packaging material, which are joined to said central area and are completely severable in use.

14. A packaging material as claimed in claim 13, wherein said further bridges are crossed by said cutting line.

15. A packaging material as claimed in claim 1, wherein said permanent bridge extends from said central area to the rest of the packaging material along a direction transversal to a lamination direction of said packaging material.

16. A packaging material as claimed in claim 1, wherein said peripheral area for cutting interaction comprises two said pre-laminated openings separated from each other by said permanent bridge and by another bridge of whole packaging material joined to said central area.

17. A packaging material as claimed in claim 16, wherein said another bridge is a pierceable bridge completely crossed by said cutting line.

18. A packaging material as claimed in claim 16, wherein said another bridge is a permanent bridge and wherein two said arc-shaped cutting lines are provided which are completely contained within the respective prelaminated openings.

19. A packaging material as claimed in claim 16, wherein said permanent bridge and said another bridge are located along an axis parallel to a lamination direction of said packaging material.

20. A packaging material as claimed in claim 19, wherein said permanent bridge extends along said peripheral area to a greater length than said another bridge; and said lamination direction is from said permanent bridge to said another bridge.

21. A packaging material as claimed in claim 16, wherein said peripheral area for cutting interaction comprises a third prelaminated opening also formed by a through slot provided at least in said base layer and covered externally with lamination layers; and a third completely severable bridge of whole packaging material, which is interposed between said another prelaminated opening and said third prelaminated opening, is joined to said central area, and is located to a side of the axis connecting said permanent bridge and said another bridge so as to face said prelaminated opening.

22. A packaging material as claimed in claim 21, wherein said cutting line crosses said another prelaminated opening and said third prelaminated opening.

23. A packaging material as claimed in claim 1, wherein it further comprises a reference mark printed or creased within said central area of said removable portion at the curvature center of said cutting line.

24. A packaging material as claimed in claim 1, and comprising a number of fold lines along which the packaging material is folded to form said package, and wherein said removable portion is crossed by one of said fold lines.

25. A packaging material as claimed in claim 24, wherein said fold line crossing said removable portion separates two portions of said packaging material eventually defining walls, crosswise to each other, of said package.

26. A packaging material as claimed in claim 1, wherein said lamination layers comprise layers of heat-seal plastic material and oxygen-barrier material.

27. A sealed package, for pourable food products, formed by folding and sealing a packaging material as claimed in claim 1, and comprising a reclosable opening device having an axis and in turn comprising:

a frame fitted about said removable portion and defining a pouring spout;

a removable threaded cap that screws onto said frame to close said pouring spout;

a tubular cutter engaging said pouring spout and having, at one axial end, cutting means which cooperate with said peripheral area of said removable portion to unseal said package and define said pour opening;

first connecting means connecting said cap to said cutter, and which, in use, as the cap is unscrewed off the frame, exert rotational thrust on the cutter; and second connecting means connecting said frame to said cutter, and which, in use, feed the cutter along a predetermined cutting path through said peripheral area of said removable portion in response to unscrewing of said cap.

28. A sheet packaging material for producing a sealed package of a pourable food product, the sealed package including an opening device comprised of a rotatable cutter, said packaging material comprising:

at least one base layer for imparting stiffness;

at least one lamination layer applied to and covering said base layer; and a removable portion which, in use, is partly detachable from a remainder of the packaging material along at least one arc-shaped cutting line by rotation of the cutter and folded at a folding zone extending between opposite ends of the cutting line so as to free a pour opening by which to pour the food product from the package, the opposite ends of the arc-shaped cutting line being spaced apart, a portion of the packaging material that includes both the base layer and the lamination layer constituting a permanent bridge positioned between the spaced-apart opposite ends of the arc-shaped cutting line;

wherein the removable portion possesses a center and comprises:

a central area, inclusive of the center, made of whole packaging material and which, in use, remains attached to the rest of the packaging material through the permanent bridge defined by the folding zone, the whole packaging material of which the central portion, inclusive of the center, is made including the base layer and the lamination layer; and a peripheral area for cutting interaction, extending around part of the central area, containing the cutting line and including at least one pre-laminated opening, which is formed by a through slot provided at least in the base layer and covered by the at least one lamination layer.

* * * * *